US007372357B2

(12) United States Patent
Nakano

(10) Patent No.: US 7,372,357 B2
(45) Date of Patent: May 13, 2008

(54) VARISTOR BODY AND VARISTOR

(75) Inventor: Mutsuko Nakano, Tokyo (JP)

(73) Assignee: TDK Corporation, Tokyo (JP)

( * ) Notice: Subject to any disclaimer, the term of this patent is extended or adjusted under 35 U.S.C. 154(b) by 0 days.

(21) Appl. No.: 11/727,444

(22) Filed: Mar. 27, 2007

(65) Prior Publication Data

US 2007/0229208 A1 Oct. 4, 2007

(30) Foreign Application Priority Data

Mar. 31, 2006 (JP) ..... 2006-099472

(51) Int. Cl.
*H01C 7/10* (2006.01)

(52) U.S. Cl. ..... 338/21; 338/20

(58) Field of Classification Search ..... 338/20–21, 338/13, 52, 54, 83, 223–224
See application file for complete search history.

(56) References Cited

U.S. PATENT DOCUMENTS 5,369,390 A * 11/1994 Lin et al. ..... 338/21
5,854,586 A * 12/1998 McMillan et al. ..... 338/21
6,100,785 A * 8/2000 Kato et al. ..... 338/20
6,184,770 B1 * 2/2001 Nakamura et al. ..... 338/21

FOREIGN PATENT DOCUMENTS

JP A 09-246017 9/1997

* cited by examiner

*Primary Examiner*—K. Richard Lee
(74) *Attorney, Agent, or Firm*—Oliff & Berridge, PLC

(57) ABSTRACT

A preferred varistor body 2 has a structure of alternately laminated internal electrode layer 12 and varistor layer 14. The varistor layer 14 has a composition containing ZnO as the main component, and Co, Pr, and Zr as the auxiliary components. An analysis of the varistor body 2 in the depth direction from the surface thereof satisfies the formula (1) and (2):

$$0.4\times Z_1/Z_0+0.5\leqq P_1/P_0\leqq 0.4\times Z_1/Z_0+0.9 \quad (1)$$

$$1<Z_1/Z_0<2.2 \quad (2)$$

where, $Z_0$ is the Zr content at a reference depth where the Zr content becomes almost constant, $Z_1$ is the Zr content at a level of 2 μm at the surface side above the reference depth, $P_0$ is the Pr content at the reference depth, and $P_1$ is the Pr content at a level of 2 μm at the surface side above the reference depth.

2 Claims, 5 Drawing Sheets

VARISTOR BODY AND VARISTOR

BACKGROUND OF INVENTION

1. Field of the Invention

The present invention relates to a varistor body and a varistor having the same.

2. Related Background Art

Varistor is an element showing a voltage nonlinear characteristic which keeps insulation property with high resistance up to a certain voltage, and dramatically becomes a low resistance above that certain voltage to allow current to flow therethrough, (hereinafter referred to as the "varistor characteristic"). Utilizing the characteristic, the varistor is used as an element for protecting a circuit of electronics device in case of generation of abnormal voltage (surge), and the like. In recent years, the varistor has become miniature scale, and is expected to be used as an inexpensive surge-protection element in digital cameras, cell phones, and the like substituting for existing Zener diode.

Known varistors include a laminated type varistor having a structure of a varistor body prepared by laminating alternately a varistor layer providing the varistor characteristic and an internal electrode layer, and an external electrode which is attached to outside of the varistor body and is connected to the internal electrode layer. Other than that type, there is known an array type varistor having a structure of combining pluralities of above elements.

The varistors having above structures are often fixed and connected to printed circuit board and the like by soldering the external electrode. Ordinary external electrodes are, however, likely fused and dispersed into the solder, which likely induces connection failure. To cope with the drawback, conventional external electrodes are prepared with a substrate electrode and a plating layer of Ni and the like formed on the surface thereof, thus improving the heat resistance. From the point of production cost and other variables, the formation of that type of plating layer is generally done by electroplating.

Since, however, the varistor body (varistor layer) has above-described semiconductor characteristic, the insulation resistance is inherently not so large. Consequently, on applying electroplating, there are conventionally often occurred the formation of plating with running-over portion thereof from the range to form the substrate electrode, (that kind of phenomenon is hereinafter referred to as the "plating extension"), and the adhesion of plating to positions other than the substrate electrode, (that kind of phenomenon is hereinafter referred to as the "plating adhesion"). Those phenomena of plating extension and plating adhesion are not welcomed because they have become significant causes of short-circuit between external electrodes along with the recent movement of miniaturization of varistor.

To avoid the problem, there is a known countermeasure which covers the surface of varistor body, other than the external electrode, with an insulation coating layer such as glass coat. That type of countermeasure, however, requires forming the glass coat film at precise dimensions, which raises other problems such as complex production process and increased production cost.

Another countermeasure to attain good electroplating is disclosed as a method of diffusing Li or Na into a region in the vicinity of surface of the varistor body, (refer to Japanese Patent Application Laid-Open No. 9-246017). The method brings the region in the vicinity of the surface of varistor body to high resistance, thus suppressing the plating formation on other part than the substrate electrode.

SUMMARY OF THE INVENTION

There are, however, cases that the countermeasure disclosed in Japanese Patent Application Laid-Open No. 9-246017 cannot fully prevent the plating extension and plating adhesion during plating. In particular, when Li or Na is to diffuse into a deep region, there is a tendency of difficult to suppress the plating extension and plating adhesion.

Therefore, the present invention has been derived to cope with the above situations, and an object of the present invention is to provide a varistor body that surely forms a varistor inducing little plating extension and plating adhesion. Another object of the present invention is to provide a varistor equipped with the varistor body of the present invention.

To achieve the above objects, the inventors of the present invention carried out detail studies, and found that the conventional varistor body has not-fully homogeneous composition in the region near the surface thereof, which likely induces the above-described plating extension and plating adhesion. That is, since the composition of the region in the vicinity of the surface of the varistor body is not homogeneous, the resistance in the vicinity of the surface of varistor body shows non-uniform distribution, which causes the plating extension and plating adhesion. During the plating treatment, there are occurred etching and elution on the surface of the varistor body. With a varistor body having a non-homogeneous composition in the vicinity of the surface thereof, however, uniform etching and elution are difficult to attain, which also becomes a cause of the plating extension and plating adhesion.

The method of Japanese Patent Application Laid-Open No. 9-246017 aims to increase the resistance in the vicinity of the surface by diffusing Li or Na into the varistor body. Even with that high resistance varistor body, however, the non-homogeneity issue of composition in the vicinity of the surface thereof cannot fully be solved, and it is difficult to fully suppress the plating extension and plating adhesion.

In this regard, the inventors of the present invention conducted further studies on the basis of the above findings, and found that the regulation of the contents of Zr and Pr at a region near the surface of the varistor body to satisfy specific conditions, respectively, further surely decreases the plating extension and the plating adhesion, thus perfected the present invention.

That is, the varistor body of the present invention is the one containing a varistor material, wherein the varistor material has a composition containing ZnO as the main component, and Co, Pr, and Zr as the auxiliary components, and an analysis of the varistor body in the depth direction from the surface thereof satisfies the formula (1) and (2):

$$0.4\times Z_1/Z_0+0.5\leqq P_1/P_0\leqq 0.4\times Z_1/Z_0+0.9 \quad (1)$$

$$1<Z_1/Z_0<2.2 \quad (2)$$

where, $Z_0$ is the Zr content at a reference depth where the Zr content becomes almost constant, $Z_1$ is the Zr content at a level of 2 μm at the surface side above the reference depth, $P_0$ is the Pr content at the reference depth, and $P_1$ is the Pr content at a level of 2 μm at the surface side above the reference depth.

According to the above varistor body, even when a substrate electrode is formed and a plating is formed thereon, the plating extension and the plating adhesion significantly decrease. Although the causes of the phenomenon are not fully analyzed, a presumable reason is as follows. Since a non-uniformity of composition and a local difference of resistance in a region near the surface act as nuclei for forming plating, they likely become the cause of plating extension and plating adhesion. On the other hand, the varistor body according to the present invention contains auxiliary components (Pr, Zr), which specifically likely become the cause of non-uniformity of composition and local difference of resistance in the vicinity of the surface, so as to satisfy the above specific conditions. As a result, the varistor body according to the present invention shows small non-uniformity of composition and local difference of resistance in a region near the surface, thus suppressing the plating extension and the plating adhesion. As described above, during plating, elution and etching on the surface of the varistor body may probably proceed simultaneously. The varistor body of the present invention, however, has small non-uniformity of composition and local difference of resistance in a region near the surface, thus the elution and the etching can favorably be controlled. Also with the phenomenon, the plating extension and the plating adhesion can considerably be decreased.

The varistor according to the present invention has the varistor body of the present invention, a substrate electrode formed on the surface of the varistor body, and a plating layer formed on the surface of the substrate electrode. Since the varistor having the structure is prepared by using the varistor body of the present invention, the plating extension and the plating adhesion occur very little, and failures such as short-circuit occur very little.

DESCRIPTION OF THE PREFERRED EMBODIMENTS

Figure 1:
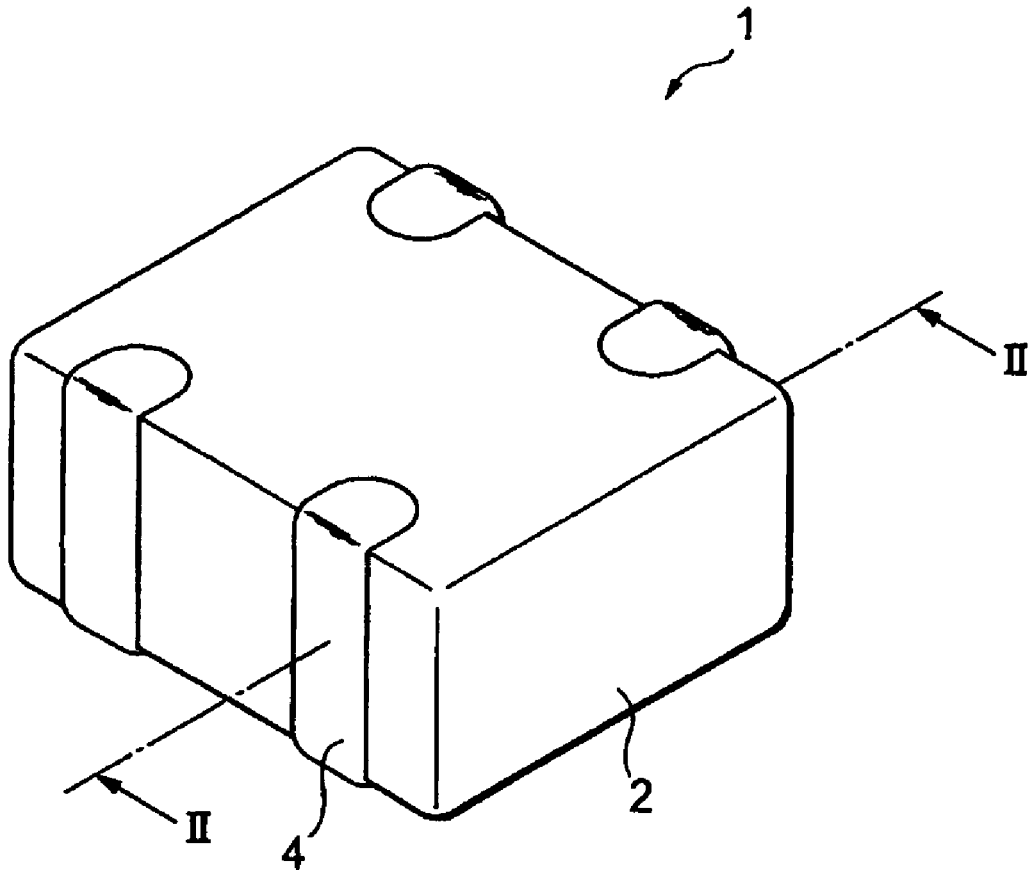
FIG. 1 is a perspective view of a varistor in a preferred embodiment.

Preferred embodiments of the present invention will be described below referring to the drawings. In the description of the drawings, the same element is expressed with the same reference numeral, and no duplicated description is given.

Figure 2:
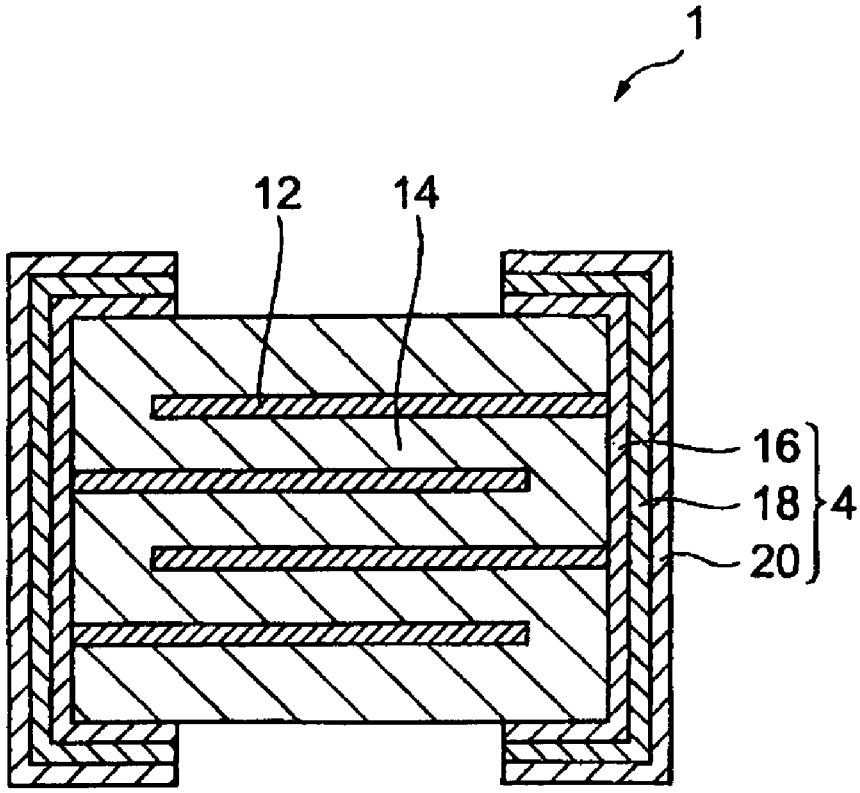
FIG. 2 is a schematic drawing of cross sectional structure along II-II line of the varistor in FIG. 1.

FIG. 1 shows a perspective view of a varistor of a preferred embodiment, FIG. 2 shows a schematic drawing of a cross sectional structure of the varistor along II-II line in FIG. 1.

As illustrated in FIG. 1, a varistor 1 is structured by a varistor body 2 in almost rectangular parallelepiped shape, and each two terminal electrodes 4 positioned on each of the opposing edge faces of the varistor body 2. The terminal electrodes 4 are positioned so as the one formed on an edge face of the varistor 2 to face the other formed on the other edge face thereof. Then, a portion being sandwiched between the opposing pair of terminal electrodes forms a single varistor. With the configuration, the varistor 1 is an array type varistor structured by combining substantially two varistors.

As illustrated in FIG. 2, in the varistor body 2, an internal electrode layer 12 and a varistor layer 14 are alternately arranged so as the varistor layer 14 to become outer side. In other words, the varistor body 2 has a structure that pluralities of internal electrode layers 12 are included in the structure of the varistor material prepared by laminating pluralities of varistor layers 14. The terminal electrode 4 has a three-layered structure of, in an order from the varistor body 2 side, a substrate electrode 16, a first plating layer 18, and a second plating layer 20.

The plurality (four in this case) of internal electrode layers 12 are arranged in almost parallel with each other so as an edge part of the internal electrode layer 12 there each to expose alternately to the respective opposing edge faces of the varistor body 2. The internal electrode layers 12 contact with the respective substrate electrodes 16, at the exposed portion. With the configuration, the internal electrode layer 12 and the substrate electrode 16 are electrically connected with each other. The material for the internal electrode layer 12 is a conductive material normally used for the internal electrode layer of varistor without specific limitation, and Ag, Pd, Ag—Pd alloy, and the like are preferred. A preferable thickness of the internal electrode layer 12 is in a range from 0.5 to 5 μm.

The varistor layer 14 is a layer having a composition containing zinc (Zn), cobalt (Co), praseodymium (Pr), and zirconium (Zr) as the essential elements. More specifically, the varistor layer 14 is a layer containing zinc oxide (ZnO) as the main component, preferably 69.0 to 99.8% by mass of zinc oxide in the layer, with the auxiliary components of Co, Pr, and Zr as single metal or oxide thereof. Adding to the above components, the varistor layer 14 may further contain trace amount of other rare earth elements, III group elements (B, Al, Ga, In, and the like), alkali metal elements (Li, K, Rb, Cs, and the like), and alkali earth metal elements (Mg, Ca, Sr, Ba, and the like). In the varistor layer 14, these auxiliary components are not necessarily dispersed uniformly in the layer, and they may exist locally. A preferable thickness of the varistor layer 14 is in a range from 5 to 100 μm.

The substrate electrode 16 formed on each opposing edge face of the varistor body 2 is made of a material which can attain good electric connection with the internal electrode layer 12, and a preferable material thereof includes Ag, Pd, Pt, and alloy of them. Examples of the first plating layer 18 and the second plating layer 20 formed on the surface of the substrate electrode 16 include a nickel (Ni) plating layer and a tin (Sn) plating layer. With these plating layers, the connection with the external substrate and the like of the varistor 1 becomes advantageous compared with the structure of sole substrate electrode 16, and the heat resistance and other characteristics of the terminal electrode 4 improve.

The varistor 1 of the present embodiment has the above structure. The varistor body 2 in the varistor 1, (the structure of the varistor material), is formed so as a region in the vicinity of the surface thereof to satisfy the following conditions.

That is, when a depth, where an analysis of the varistor layer 14 in the depth direction from the surface of the varistor body 2 shows an almost constant Zr content, is defined as the "reference depth", the formula (1) and (2):

$$0.4\times Z_1/Z_0+0.5 \leqq P_1/P_0 > 0.4\times Z_1/Z_0+0.9 \quad (1)$$

$$1 < Z_1/Z_0 < 2.2 \quad (2)$$

where, $Z_0$ is the Zr content at the reference depth, $Z_1$ is the Zr content at a level of 2 μm at the surface side above the reference depth, $P_0$ is the Pr content at the reference depth, and $P_1$ is the Pr content at a level of 2 μm at the surface side above the reference depth.

The "content" of each element at a certain measurement point may be a relative value calculated from the composition ratio of individual elements observed at each measurement point For example, there may be applied a value of parts by mass of the target element to 100 parts by mass of the sum of Zn, Co, and Pr contents at the measurement point. The contents of elements in the varistor body 2 can be determined by a laser abrasion-ICP-mass spectrometer (LA-ICP-MS). The measurement is conducted by detecting the element under laser irradiation to the varistor body 2, (under the laser condition of 20 μm of wavelength and 10 Hz of frequency), while forming a hole (about 100 μm in diameter) in the depth direction from the surface, then by determining the sensitivity of the element at each depth. Thus obtained sensitivity of the element is converted to the composition (mass ratio) by the correction with the sensitivity coefficient for the element concerned. Based on the obtained composition value, the content of the element (% by mass) at each depth is calculated.

Figure 3:
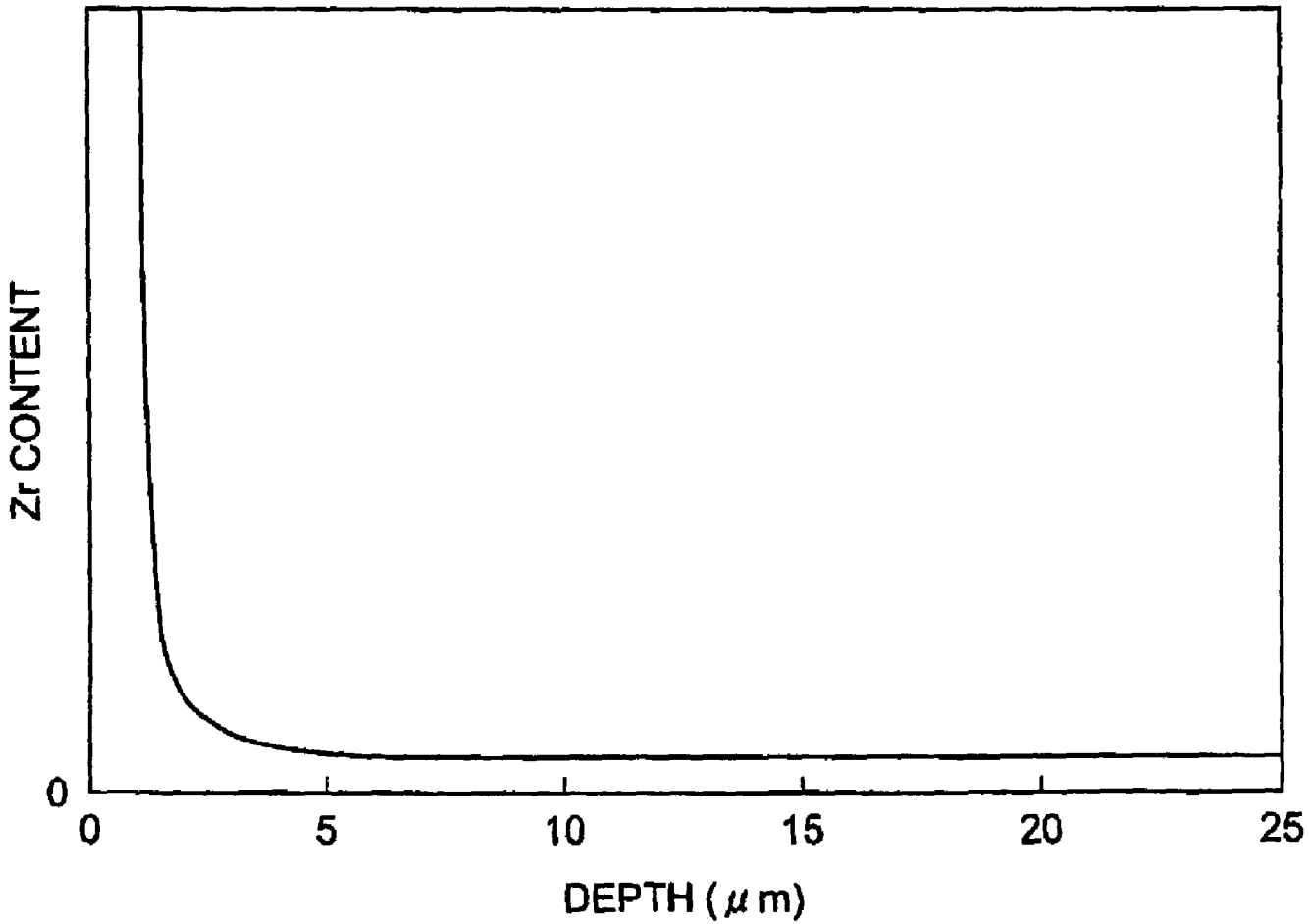
FIG. 3 is a graph showing an example of determination of Zr content in the depth direction from the surface of a varistor body 2.

The "depth (μm)" from the surface can be defined as the value which is calculated from the laser irradiation time in the above measurement and from the average rate of cutting the varistor body 2 in the depth direction by the laser. The "depth where the Zr content becomes almost constant" signifies the minimum depth, under the comparison between the Zr content at a level concerned and the Zr content at sufficiently deeper level, giving almost equal (within differences of about ±3%) Zr content. The depth of sufficiently deep may be the depth of 10 to 25 μm from the surface of the varistor body 2. As an example, FIG. 3 shows the observed graph of Zr content in the depth direction from the surface of the varistor body 2. As seen in the figure, the Zr content decreases with the depth of the varistor body 2 from the surface, and reaches almost constant value at a certain depth.

In the varistor body 2, by specifying the region so as the value of $P_1/P_0$ to satisfy a specific condition against the value of $Z_1/Z_0$, the region near the surface of the varistor body 2 favorably becomes high resistance. As a result, even when plating is applied on the substrate electrode 16 formed on the varistor body 2, the plating extension and the plating adhesion come to hardly occur.

If the value of $P_1/P_0$ exceeds the above-given upper limit ($0.4\times Z_1/Z_0+0.9$), the plating adhesion likely occurs. If the value of $P_1/P_0$ is smaller than above-given lower limit ($0.4\times Z_1/Z_0+0.5$), the plating extension likely occurs. Further, if the value of $Z_1/Z_0$ exceeds 2.2, both the plating extension and the plating adhesion likely occur, in particular local or whole plating adhesion may occur to result in insufficient characteristic of the varistor 1. Since Zr concentration increases from inside to the surface of the varistor body 2, the minimum value of $Z_1/Z_0$ generally becomes one.

As described above, adding to the essential elements, the varistor layer 14 may further contain other rare earth elements, III group elements, alkali metal elements, alkali earth metal elements, and the like. In particular, when the varistor layer 14 contains an alkali metal (specifically Li) in a region near the surface of the varistor body 2, the region in the vicinity of the surface of varistor body 2 becomes favorably high resistance, which favorably suppresses the plating extension and the plating adhesion.

Specifically, the alkali metal is preferably diffused in a range from the surface to depths of 2 to 10 μm of the varistor body 2. If the alkali metal exists in a depth deeper than 10 μm, the composition in the vicinity of the surface of varistor body 2 becomes non-homogeneous, which makes it difficult to attain favorable surface resistance. If the varistor layer 14 contains Li as the alkali metal, a preferable content of Li is 0.08 parts by mass or less to 100 parts by mass of the sum of Zn, Co, and Pr contents at a level of 2 μm at the surface side above the reference depth. When the contents of Li, Zr, and Pr satisfy all the above-described conditions, the plating extension and the plating adhesion extremely decrease to a favorable level.

Figure 4:
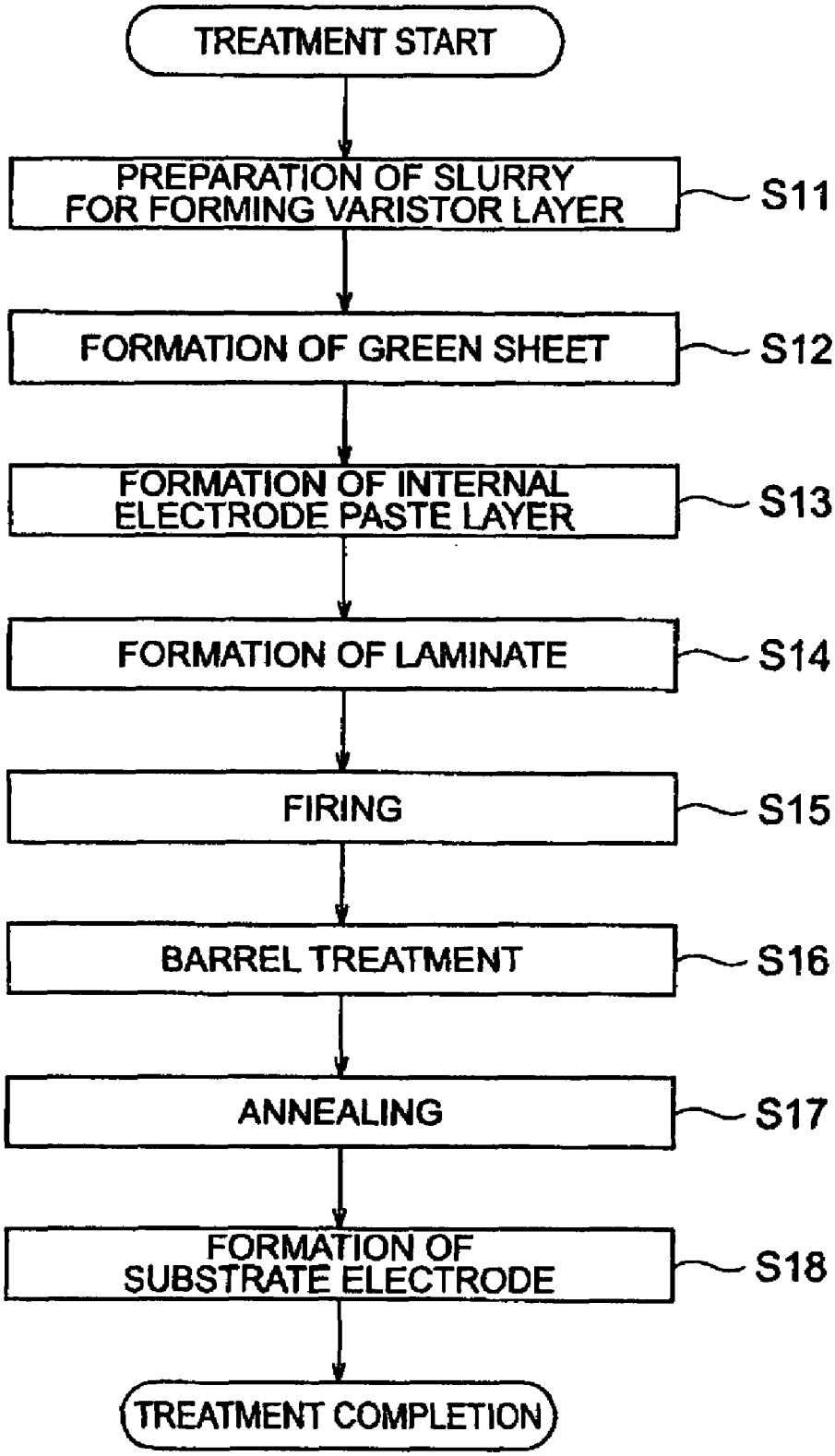
FIG. 4 is the flow chart of a preferred manufacture process of varistor 1.

A preferred manufacturing method of the varistor 1 having above structure is described below. FIG. 4 is the flow chart of a preferred manufacturing process of the varistor 1.

For manufacturing the varistor 1, a slurry to form the varistor layer, (slurry for forming the varistor layer), is prepared, (Step S11). In this step, ZnO which is the main component of the varistor layer 2, and other components including Co, Pr, Zr, and the like which are the auxiliary components thereof are weighed to obtain a desired composition, which are then mixed together. Subsequently, an organic binder, an organic solvent, an organic plasticizer, and the like are added to the mixed components, which are blended together to obtain the slurry for forming the varistor layer. Since the Li, which is added as needed, is added to the varistor body 2 in the step described below so that the Li is not added in this step.

Then, thus prepared slurry for forming the varistor layer is applied onto a base film such as polyethylene terephthalate (PET) film using a known method such as doctor blade method. The applied slurry is dried to form a film having about 30 μm in thickness. Thus formed film is peeled off from the PET film to obtain a green sheet, (Step S12).

A paste for forming the internal electrode is prepared by mixing an organic binder and the like with a metallic material powder such as Ag—Pd alloy that structures the internal electrode. Thus prepared paste for forming the internal electrode is printed on the green sheet by the screen-printing process or the like, which is then dried to form the internal electrode paste layer having a specified pattern thereon, (Step S13).

After preparing a specified number (four in this embodiment) of the green sheets on which the respective internal electrode paste layers are formed, they are arranged and laminated so as the individual internal electrode paste layers become the same side to the respective green sheets. After covering the internal electrode paste layer which is exposed to outermost side with a green sheet on which no internal electrode paste layer is formed, the entire structure is pressed to form a laminate. By cutting the laminate to a desired size, a green chip is obtained, (Step S14). The obtained green chip is dried, as needed, by heating or other means.

After that, the green chip is subjected to heat treatment at approximately 180° C. to 400° C. for about 0.5 to 24 hours as the binder-removal treatment to remove the binder and the solvent from the individual layers, followed by further firing at approximately 1000° C. to 1400° C. for about 0.5 to 8 hours, (Step S15), thus forming the varistor body 2. The firing forms the internal electrode layer 12 from the internal electrode paste layer in the green chip, and the varistor layer 14 is formed from the green sheet.

Next, a barrel treatment is given to the varistor body 2, (Step S16). When Li coexists in the region in the vicinity of the surface of the varistor body 2, as described above, the barrel treatment is conducted while coexisting with a Li diffusion source, thus letting the Li diffusion source adhere to the surface of the varistor body 2. That type of barrel treatment can be done in the following procedure.

First, the varistor body 2 and a Li compound as the Li diffusion source are placed in a pot containing a medium. The Li compound may be an oxide, hydroxide, chloride, nitrate, borate, or carbonate of Li. Then, the pot is rotated or subjected to other means to agitate the varistor body 2, the medium, and the Li compound, thus to bring the Li compound to adhere to the surface of the varistor body 2. The quantity of adhered Li compound can be varied by adjusting the amount of medium, the diameter of medium, the number of the varistor body 2 being treated at a time, the added amount of Li compound, and other variables.

After that, to the varistor body 2 after finishing the barrel treatment, annealing treatment is applied, (Step S17). When the Li compound adheres to the surface of the varistor body 2, the annealing treatment diffuses the Li into the varistor body 2 from the surface utilizing the adhered Li compound as the diffusion source. The annealing treatment is preferably done by arranging the varistor body 2 in a desired vessel to heat the varistor body 2 to an approximate temperature range from 700° C. to 1000° C. for about 10 minutes to 2 hours. The annealing condition can be adjusted appropriately responding to the Li adhesion quantity and to the desired degree of diffusion.

Then, the substrate electrode paste containing mainly a metallic material to structure the substrate electrode is applied onto a desired position on the surface of the varistor body 2. The paste is then subjected to heat treatment at about 550° C. to about 850° C., (baking). Thus the substrate electrode 16 is formed on the opposing edge faces on the varistor body 2, (Step S18).

On the surface of the substrate electrode 16, plating is given, for example in the order of Ni plating and Sn plating, by electroplating or the like, thus forming the first plating layer 18 and the second plating layer 20, respectively. Through the procedure, the varistor 1 having the structure shown in FIG. 1 and FIG. 2 is obtained.

The above description is given to the varistor body, the varistor, and the method for manufacturing thereof according to a preferred embodiment of the present invention. The present invention, however, is not limited to the above embodiment. For example, the above embodiment deals with an example of varistor array having substantially two varistors. The present invention is not limited to the structure but may be a single varistor, or a varistor array structured by three or more of varistors. In addition, the embodiment showed an example of varistor in a laminated form having the varistor layer and the internal electrode layer alternately laminated. For example, however, a single layer type arranging a varistor layer between a pair of electrodes may be adopted.

According to the manufacturing method in the embodiment, on diffusing Li into the varistor body 2, the Li compound adheres onto the surface of the varistor body 2 during the barrel treatment, and then the annealing is given. The method of diffusing Li is, however, not limited to this method. For instance, the annealing treatment given under the diffusion condition of existence of the Li diffusion source in gas phase can also diffuse the Li in the varistor body. In that case, during the barrel treatment before the annealing treatment, the Li compound may or may not adhere to the varistor body.

EXAMPLES

The present invention is described below in more detail referring to the examples. The present invention is, however, not limited to these examples.

[Manufacture of Varistor Body]

A large number of varistor bodies were manufactured following the steps S11 to S17 given in FIG. 4. The combinations of the firing condition (Step S15) and the annealing condition (Step S17) were varied to 3 types, thus manufactured varistor bodies in 3 groups. These groups were named respectively as the Manufacture Examples 1 to 3 depending on the combinations of firing condition and annealing condition.

In these manufacturing examples, the material forming the varistor layer was the one containing ZnO of 99.9/o purity (99.725% by mole) with the addition of 0.5% by mole of Pr, 1.5% by mole of Co, 0.005% by mole of Al, 0.05% by mole of K, 0.1% by mole of Cr, 0.1% by mole of Ca, 0.02% by mole of Si, and 0.01% by mole of Zr. The material for forming the internal electrode layer was an Ag—Pd alloy. The raw material for diffusing Li, (Li compound), into the varistor body was $Li_2CO_3$. The use amount of the $Li_2CO_3$ was 1 μg per a single varistor body.

Manufacture Example 1

The firing was conducted by total 14 hours of treatment containing the steps of heating the varistor body to 1200° C. at a heating rate of 200° C./hr, of holding the varistor body at the temperature of 1200° C. for 2 hours, and of cooling the varistor body at a cooling rate of 200° C./hr. The annealing was conducted under the conditions of heating the varistor body to 850° C. in 20 minutes, holding the varistor body at the temperature of 850° C. for 20 minutes, and then cooling the varistor body to the original temperature in 20 minutes.

Manufacture Example 2

The firing and the annealing were given under the same condition as that of Manufacture Example 1. However, instead of the method of Li diffusion to the varistor body by annealing after adhering of the Li compound in the barrel treatment, Manufacture Example 2 conducted the Li diffusion in gas phase not by the method of adding the Li compound in the barrel treatment but by the method of coexistence of $Li_2CO_3$ in the furnace in the annealing.

Manufacture Example 3

The firing was conducted by total 13 hours of treatment containing the steps of heating the varistor body to 1200° C. at a heating rate of 200° C./hr, of holding the varistor body at the temperature of 1200° C. for 1 hour, and of cooling the varistor body at a cooling rate of 200° C./hr. The annealing was conducted under the conditions of heating the varistor body to 850° C. in 20 minutes, holding the varistor body at the temperature of 850° C. for 20 minutes, and then cooling the varistor body to the original temperature in 20 minutes. Furthermore, Manufacture Example 3 conducted the Li diffusion in the varistor body by the same method as that in Manufacture Example 2.

[Determination of $P_1/P_0$ and $Z_1/Z_0$]

Each ten samples of varistor body were taken from each group of varistor bodies in Manufacture Examples 1 to 3, (ten samples collected from each manufacture example were numbered to "Samples Nos. 1 to 10). On the portion of varistor layer exposed on the surface of each of the sampled varistor bodies, the analysis in depth direction from the exposed surface of varistor layer was given using LA-ICP-MS (LUV266X made by New Wave Research, Inc. for laser section; and Agilent 7500S made by Yokogawa Analytical Systems Co., Ltd. for ICP-MS section).

Figure 5:
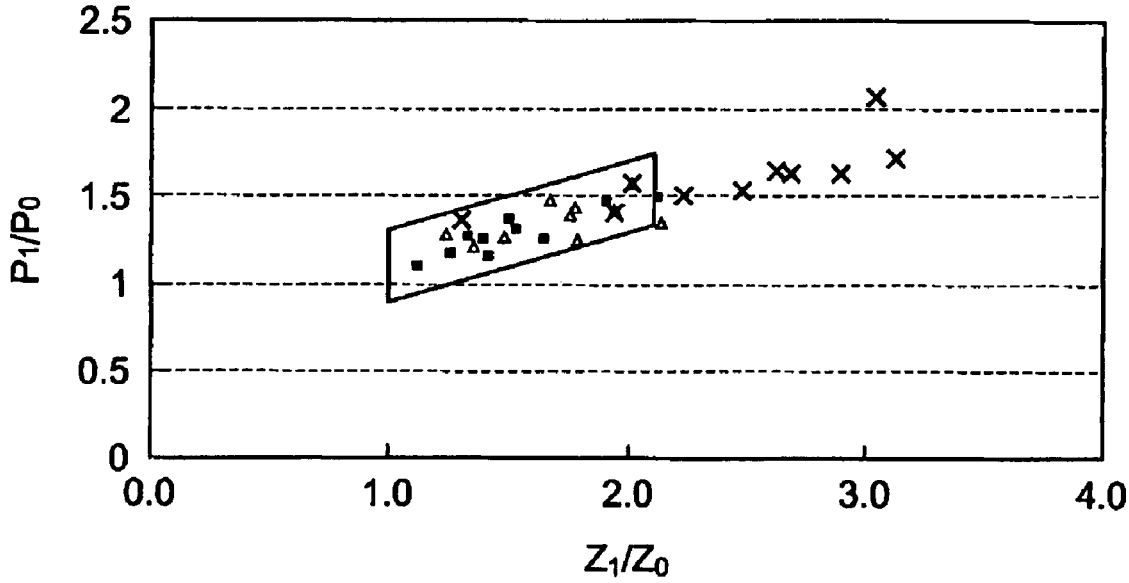
FIG. 5 is a graph showing the values of $P_1/P_0$ against the values of $Z_1/Z_0$ for each sample of Manufacture Examples 1 to 3.

The reference depth where the Zr content becomes almost constant was defined. Based on the obtained results, there were determined: the $Z_0$ which is the Zr content at the reference depth, the $Z_1$ which is the Zr content at a level of 2 μm at the surface side above the reference depth, the $P_0$ which is the Pr content at the reference depth, and the $P_1$ which is the Pr content at a level of 2 μm at the surface side above the reference depth The values of $Z_1/Z_0$ and $P_1/P_0$ were calculated for all the samples corresponding to each example. The results are given in Table 1. The values of $P_1/P_0$ to the respective values of $Z_1/Z_0$ obtained from individual samples are shown in FIG. 5. The plots in FIG. 5 have trigona mark for the manufacture example 1, square mark for the manufacture example 2, and X mark for the manufacture example 3. The region enclosed by solid line in FIG. 5 corresponds to the region satisfying the formula (1) and (2).

$$0.4\times Z_1/Z_0+0.5\leqq P_1/P_0\leqq 0.4\times Z_1/Z_0+0.9 \quad (1)$$

$$1<Z_1/Z_0<2.2 \quad (2)$$

TABLE 1

| | Manufacture Example 1 | | Manufacture Example 1 | | Manufacture Example 1 | |
|---|---|---|---|---|---|---|
| | $Z_1/Z_0$ | $P_1/P_0$ | $Z_1/Z_0$ | $P_1/P_0$ | $Z_1/Z_0$ | $P_1/P_0$ |
| Sample 1 | 2.14 | 1.35 | 1.53 | 1.31 | 1.94 | 1.40 |
| Sample 2 | 1.94 | 1.42 | 1.26 | 1.16 | 2.90 | 1.63 |
| Sample 3 | 1.36 | 1.20 | 1.40 | 1.25 | 2.69 | 1.64 |
| Sample 4 | 1.77 | 1.43 | 1.65 | 1.25 | 2.23 | 1.50 |
| Sample 5 | 1.78 | 1.25 | 1.33 | 1.26 | 1.30 | 1.36 |
| Sample 6 | 2.01 | 1.57 | 1.42 | 1.15 | 3.13 | 1.72 |
| Sample 7 | 1.75 | 1.39 | 1.13 | 1.10 | 2.48 | 1.53 |
| Sample 8 | 1.47 | 1.27 | 2.13 | 1.49 | 2.01 | 1.57 |
| Sample 9 | 1.67 | 1.48 | 1.91 | 1.46 | 3.04 | 2.07 |
| Sample 10 | 1.24 | 1.28 | 1.50 | 1.37 | 2.63 | 1.65 |

[Determination of Percent Defective]

Each 500 samples of varistor body were taken out from each group of varistor bodies in the respective Manufacture Examples 1 to 3. Each of the varistor bodies was subjected to Step S18 given in FIG. 4, thus forming a substrate electrode. Then, electroplating was applied to the surface of the substrate electrode in the order of Ni plating and Sn plating to form the plating layer, thereby completing the varistor.

For all of thus prepared varistors, there was checked whether the plating extension (forming a plating layer with running-over portion thereof from the range to form the substrate electrode) occurred or whether the plating adhesion (the adhesion of plating to positions other than the region of forming substrate electrode) occurred. The varistor on which no plating extension or plating adhesion occurred was defined as the non-defective. The quantity of non-defective varistors among 500 varistors for each manufacture example was counted to calculate the percentage non-defective (%). The result is given in Table 2. The case that the plating with running-over portion thereof from the range to form the substrate electrode by a distance of more than 20 μm was judged as the "plating extension", and the case that a plating larger than 20 μm in diameter adheres to the surface of the varistor body other than the region for forming the substrate electrode was judged as the "plating adhesion".

TABLE 2

| Varistor | Percentage non-defective (%) |
|---|---|
| Manufacture Example 1 | 94.7 |
| Manufacture Example 2 | 95.5 |
| Manufacture Example 3 | 49.2 |

Table 2 shows that Manufacture Examples 1 and 2 give considerably higher percentage non-defective than that of Manufacture Example 3, thus significantly decreasing the plating extension and the plating adhesion.

According to the present invention, there is provided a varistor body which surely forms a varistor with very little plating extension and plating adhesion, and provided a varistor equipped with the varistor body.

What is claimed is:

1. A varistor body containing a varistor material, wherein the varistor material has a composition containing ZnO as a main component, and Co, Pr, and Zr as auxiliary components, and an analysis of the varistor body in a depth direction from a surface thereof satisfies the formula (1) and (2):

$$0.4\times Z_1/Z_0+0.5\leqq P_1/P_0\leqq 0.4\times Z_1/Z_0+0.9 \quad (1)$$

$$1<Z_1/Z_0<2.2 \quad (2)$$

where, $Z_0$ is a Zr content at a reference depth where the Zr content becomes almost constant, $Z_1$ is a Zr content at a level of 2 μm at a surface side above the reference depth, $P_0$ is a Pr content at the reference depth, and $P_1$ is a Pr content at the level of 2 μm at the surface side above the reference depth.

2. A varistor comprising:

the varistor body according to claim 1;

a substrate electrode formed on a surface of the varistor body; and a plating layer formed on a surface of the substrate electrode.

* * * * *